US012168915B2

(12) United States Patent
El Mallawany et al.

(10) Patent No.: US 12,168,915 B2
(45) Date of Patent: Dec. 17, 2024

(54) COMPLETION STRING WITH A DOWNHOLE POWER GRID

(71) Applicant: Halliburton Energy Services, Inc., Houston, TX (US)

(72) Inventors: Ibrahim El Mallawany, Dhahran (SA); Stephen Michael Greci, Little Elm, TX (US); Michael Linley Fripp, Singapore (SG)

(73) Assignee: Halliburton Energy Services, 1nc., Houston, TX (US)

( * ) Notice: Subject to any disclaimer, the term of this patent is extended or adjusted under 35 U.S.C. 154(b) by 0 days.

(21) Appl. No.: 18/111,827

(22) Filed: Feb. 20, 2023

(65) Prior Publication Data

US 2024/0280002 A1 Aug. 22, 2024

(51) Int. Cl.

| | |
|---|---|
| ***E21B 41/00*** | (2006.01) |
| ***E21B 34/06*** | (2006.01) |
| ***E21B 43/12*** | (2006.01) |
| ***E21B 47/12*** | (2012.01) |

(52) U.S. Cl.
CPC ..... *E21B 41/0085* (2013.01); *E21B 34/066* (2013.01); *E21B 43/12* (2013.01); *E21B 47/12* (2013.01)

(58) Field of Classification Search
CPC .... E21B 41/0085; E21B 34/066; E21B 43/12; E21B 47/12; E21B 47/138
See application file for complete search history.

(56) References Cited

U.S. PATENT DOCUMENTS

| | | | |
|---|---|---|---|
| 7,602,668 B2 | 10/2009 | Liang et al. | |
| 9,461,469 B2 | 10/2016 | Li et al. | |
| 10,079,564 B2 * | 9/2018 | Huntington | H02P 9/04 |
| 10,619,435 B2 | 4/2020 | Greci et al. | |
| 10,626,702 B2 | 4/2020 | Ornelaz et al. | |
| 11,066,904 B2 | 7/2021 | Fripp et al. | |
| 11,506,031 B2 | 11/2022 | Greci et al. | |
| 2009/0101341 A1 | 4/2009 | Willauer | |
| 2016/0115782 A1 | 4/2016 | Martinez | |
| 2021/0095547 A1 | 4/2021 | Grueschow et al. | |

FOREIGN PATENT DOCUMENTS

| | | |
|---|---|---|
| WO | 2020018199 | 1/2020 |
| WO | 2020018200 | 1/2020 |

OTHER PUBLICATIONS

International Search Report and Written Opinion for International Patent Application No. PCT/US2023/016440 dated Dec. 13, 2023. PDF file. 8 pages.

* cited by examiner

*Primary Examiner* — Catherine Loikith
(74) *Attorney, Agent, or Firm* — Scott Richardson; C. Tumey Law Group PLLC

(57) ABSTRACT

A plurality of flow control nodes are spaced along a production conduit for controlling a flow of formation fluids into the production conduit at different locations in the well. Each flow control node defines a flow path for entry of the formation fluids into the production conduit. A closure is operable to adjust the flow of the formation fluids into the production conduit. A generator at each zone generates electrical power in response to a portion of the flow directed through the generator. An electrical power grid interconnects the plurality of flow control nodes to collectively supply electrical power to the power grid. Each closure and other device components are operable with the electrical power from the power grid.

18 Claims, 7 Drawing Sheets

COMPLETION STRING WITH A DOWNHOLE POWER GRID

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps including drilling a wellbore, treating the wellbore to optimize production of hydrocarbons, and completing the well by installing well components and performing steps to produce and process the hydrocarbons from the subterranean formation.

Intelligent well technology relates to oil and gas well completion technology integrated with things like underground real-time monitoring, data analysis decision-making, and remote control of downhole tools. A smart well may refer in some contexts to a well which has equipment that can be controlled either automatically or by an operator at a remote location. Smart wells may use components like valves, chokes, sensors, and actuators that are remotely monitored by both humans and software.

The use of electronics downhole requires a suitable electronic power source. Providing and maintaining electrical power downhole can be a challenge given that components of the system are very deep underground in a harsh, e.g., high-temperature, high-pressure, corrosive environment.

BRIEF DESCRIPTION OF THE DRAWINGS

These drawings illustrate certain aspects of some of the embodiments of the present disclosure and should not be used to limit or define the method.

DETAILED DESCRIPTION

Flow control systems and methods are disclosed to control production of formation fluids by controlling flow at a plurality of different locations along a well, such as in different producing zones and different locations within a producing zone. Aspects include a smart well node system that generates electrical power using the flow at each of these locations by directing a portion of that fluid flow through a generator at each flow control node. The generated electrical power may be used to operate components, such as the same valves used to control the flow. Some applications require shutting down flow temporarily at one or more locations. When flow is shut down or reduced below a threshold at any given location, the generator at that location may not provide sufficient power to operate its own devices, such as to reopen a valve used to control flow. The disclosed systems and methods provide a way to selectively reopen flow at those locations even when power drops below the threshold. The nodes may also communicate wirelessly with one another or a central controller.

Various technical advantages are provided. For example, the disclosure allows a zone to completely shut down flow and later selectively reopen flow by using power from neighboring zones. If the generator of one zone fails, for example, the zone can continue to operate by using power generated from a neighboring zones. More overall power is also available, which can increase the forces of the motors shifting flow control valves/sleeves. Instead of having a processor for each zone, a central processor can be utilized to control all zones. This approach decreases cost, simplifies wireless communication to surface, may increase reliability by having one or more redundant central processors. More power also means that the system can provide intermittent power to an auxiliary device by combining the power from multiple generators. More overall power means more sensors and other electrical instruments may be added. More overall power means a more powerful and more capable central processor. A central battery pack may be used to get charged and power downhole devices if complete well shutdown is needed.

Figure 1:
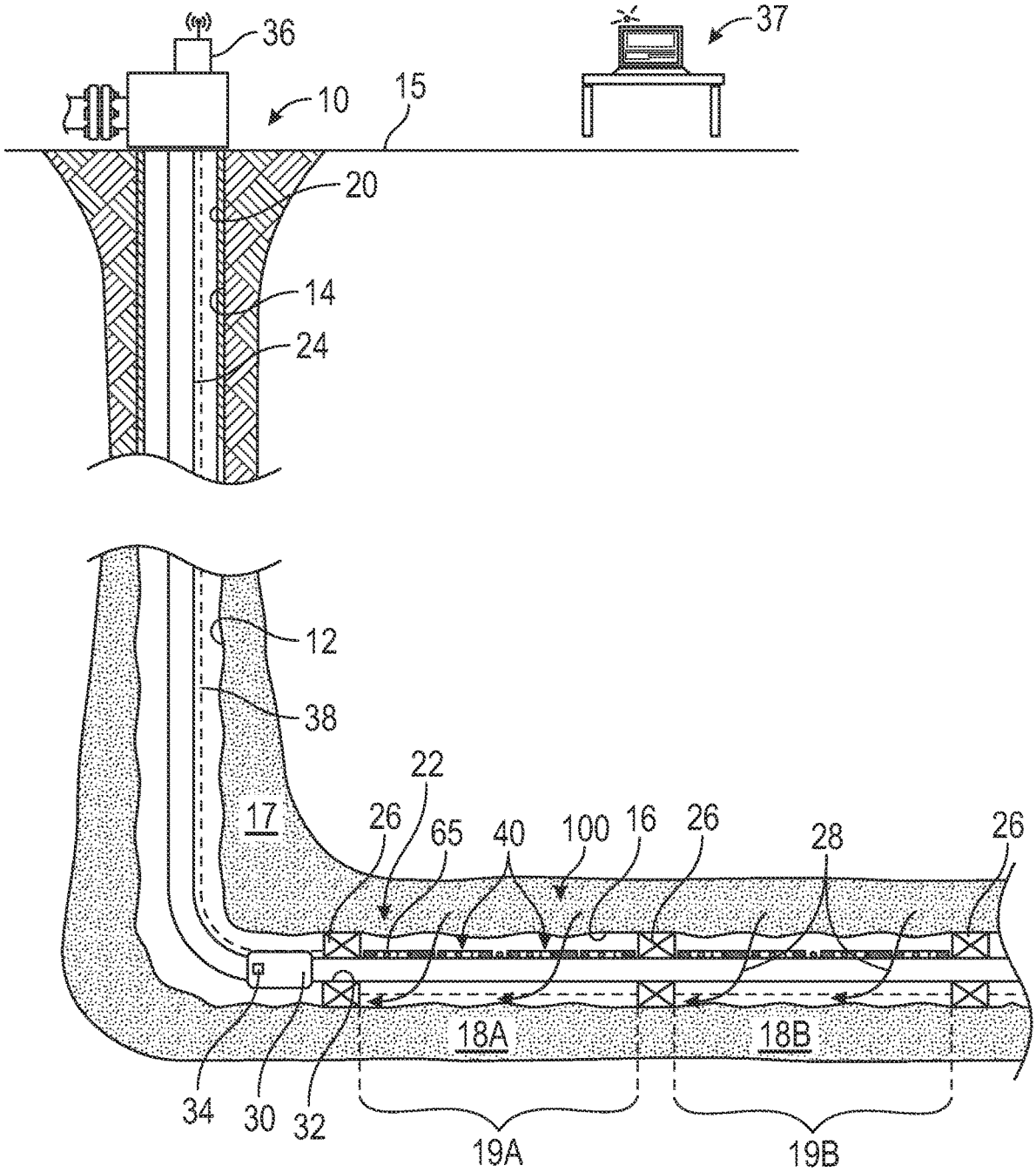
FIG. 1 is an elevation view of a well site depicting a production well in which a wireless smart well node system may be implemented according to aspects of the disclosure.

FIG. 1 is an elevation view of a well site depicting a production well 10 in which a wireless smart well node system may be implemented according to aspects of the disclosure. This and other figures are simplified for discussion, e.g., using schematic representations of elements, and are not meant to imply any particular scale except where may be otherwise noted. As depicted, the production well 10 includes a wellbore 12 that has been drilled through various earth strata of an earthen formation 17. The wellbore 12 may be formed using directional drilling techniques to conform to any given wellbore trajectory to traverse one or more hydrocarbon-bearing zones to be produced, e.g., production zones 18A and 18B. By way of example, the wellbore 12 includes a substantially vertical section 14 that transitions into a substantially horizontal section 16 that traverses the production zones 18A, 18B. The respective portions of the wellbore 12 spanning the production zones 18A, 18B may be referred to as the producing intervals 19A, 19B. Hydrocarbon fluids such as oil and gas from the production zones (i.e., formation fluids) are captured along producing intervals 19A, 19B and conveyed to the surface 15 of the well site in crude form. The produced fluids may be temporarily stored and/or transported via pipelines or vessels to refineries for further processing.

During a completion phase of constructing the well, the wellbore 12 may be lined with a tubular casing 20 cemented in placed to help reinforce the wellbore 12. By way of example, the upper part of the wellbore 12 is cased along vertical section 14, while a lower part of the well down through the horizontal section 16 is uncased and may be referred to as "open hole." A string of production tubing 24 may also be installed within the wellbore 12 as part of a completions. The production tubing 24 extends from an above-ground (i.e., surface) location 15 down to a lower completion 22 installed in the horizontal section 16 of the wellbore 12. The production tubing 24 functions as at least a portion of a conduit disposed in the wellbore 12 for production of formation fluids to the surface 15. The production tubing 24 may be included with equipment generally categorized as upper completions, which is removeable from the lower completion 22 installed in the well. The lower completion 22 includes equipment used to divide the wellbore 102 into producing intervals 19A, 19B. For example, any number of wellbore packers 26 may be deployed to provide a fluid seal between the lower completion 22 and the wellbore 12.

A smart well node system 100 according to aspects of the disclosure is included with the completions to control the production of formation fluids. The system 100 may comprise plurality of flow control nodes 40 spaced along the wellbore 12 to control the entry of formation fluid 28 into the lower completion 22 at different locations in the well 10. The plurality of flow control nodes 40 in this example span a plurality of producing intervals 19A, 19B spaced apart in the formation, wherein at least one (i.e., a first) flow control node 40 is in a first producing interval 19A and at least one other (i.e., a second) flow control node 40 is in a second producing interval 19B. Two or more flow control nodes may also be in a same producing interval, e.g., at least two flow control nodes 40 in each of producing intervals 19A, 19B.

Each flow control node 40 may include a sand control screen assembly or other filtration mechanism (not expressly shown) for filtering particulates out of the formation fluid 28 in this open-hole portion of the wellbore 12. Alternative examples may have one or more of the flow control nodes 40 arranged within a cased portions of the wellbore 12. The flow control nodes 40 are operable to regulate the flow of the formation fluid 28 at their respective locations. Thus, the relative flow of formation fluid 28 at each flow control node 40 may be controlled at different production zones 18A, 18B or within a particular producing interval 19A or 19B. The flow may be controlled, for example, to maximize production of desired hydrocarbons such as oil while minimizing production of less desirable fluids like water.

The smart well node system may also comprise a downhole controller 30 to coordinate the flow control nodes 40. The downhole controller 30 may be located at any suitable location in the completion string. For example, the downhole controller 30 may be positioned upstream of the flow control nodes 40 as shown in FIG. 1, in relatively close proximity to the flow control nodes 40 to minimize signal transmission losses. The downhole controller 30 is in communication with the flow control nodes 40 along a schematically depicted signal pathway 32 for conveyance of electrical data and/or power signals. The signal pathway 32 may be wired, wireless, or a combination thereof. In some configurations, at least a portion of the signal pathway 32 is wireless, thus serving as a wireless connection between the flow control nodes 40 and the controller 30 such that downhole controller 30 may wirelessly communicate with the flow control nodes 40 through electromagnetic signals or pressure signals. The downhole controller 30 may include a processor operable with control logic, either alone or in combination with onboard processors at each flow control node 40. For example, grid controller logic may be included for managing power between the various flow control nodes 40.

Extending uphole from the downhole controller 30 are one or more control lines 38, such as hydraulic tubing, pressurized fluid tubing, electric cable and the like which extend to the surface 15 and can be utilized for control of completion string components. The control lines 38 may extend to the downhole controller 30 for transmission of data or control signals between the surface 15 and the downhole controller 30. The downhole controller 30 may also include a telemetry device 34 facilitating communication with a surface controller 36. The telemetry device 34 may communicate with the flow control nodes 40 via, e.g., the optionally wireless connection of the signal pathway 32. The telemetry device 34 may communicate along one or more of the control lines 38 routed along the completion string, or wirelessly, such as using a network of wireless signal repeaters spaced along the completion string, a fluid pulse telemetry device, or a combination thereof. Together, the various communication devices described may form a communication network for electronic communication between each flow control node and a surface of the well site.

In some examples, the downhole controller 30 may also receive data provided by various sensors 65 located in the wellbore 12 and transmit the data to the surface controller 36. The sensors 65 may include a receiver responsive to electromagnetic radiation for measuring formation resistivity, a gamma ray device for measuring formation gamma ray intensity, devices for measuring the inclination and azimuth of the tubing string, pressure sensors for measuring fluid pressure, temperature sensors for measuring wellbore temperature, distributed optical sensors, a flow meter for measuring flow rates, geophones or accelerometers for taking seismic, microseismic, or vibration measurements, a device for measuring fluid composition, etc. Data may also be provided by the surface controller 36, received by the telemetry device 34, and transmitted to the various electronic devices located in the wellbore 12 to perform functions, such as actuating a valve.

In an example configuration, these sensors 65 in the smart well node system 100 measure downhole parameters, e.g., pressure, temperature, flow, oil/water/gas ratio, etc., and are powered by the electrical grid further described below. The sensors 65 may feed such data to a processor where the processor can use this data to autonomously optimize sleeve positions to optimize production/injection. The data may also be transmitted via wire or wireless relay to surface and receive instructions from surface to change sleeve positions. Other peripheral equipment that may be powered by the grid include, e.g., tools that release chemicals into production stream to control corrosion, emulsion, etc., control a sub surface safety valve to shut down flow in case of emergency, modify a multilateral (MLT) junction to switch intervention access from one lateral to another, and/or facilitate access to remove/install components from the side pocket discussed below.

The surface controller 36 may be located on site, such as in a rig control room, or off-site. The surface controller 36 may include a computer system for processing and storing the measurements gathered by the sensors located in the wellbore 12. The surface controller 36, the downhole controller 30, and/or on-board controllers on the flow control nodes 40 may include any of a variety of components such as a non-transitory computer-readable medium (e.g., a hard-disk drive and/or memory) capable of executing instructions to perform such tasks. In addition to collecting and processing measurements, the surface controller 36 may be capable of controlling completion, stimulation, and production operations including but not limited to as installation of the packers 26, acidizing, gravel packing, or hydraulic fracturing. The surface controller 36 may further include a user interface 37, e.g., a monitor or printer, which displays the measurements and allows an operator to implement and monitor production among the various producing intervals.

Figure 2:
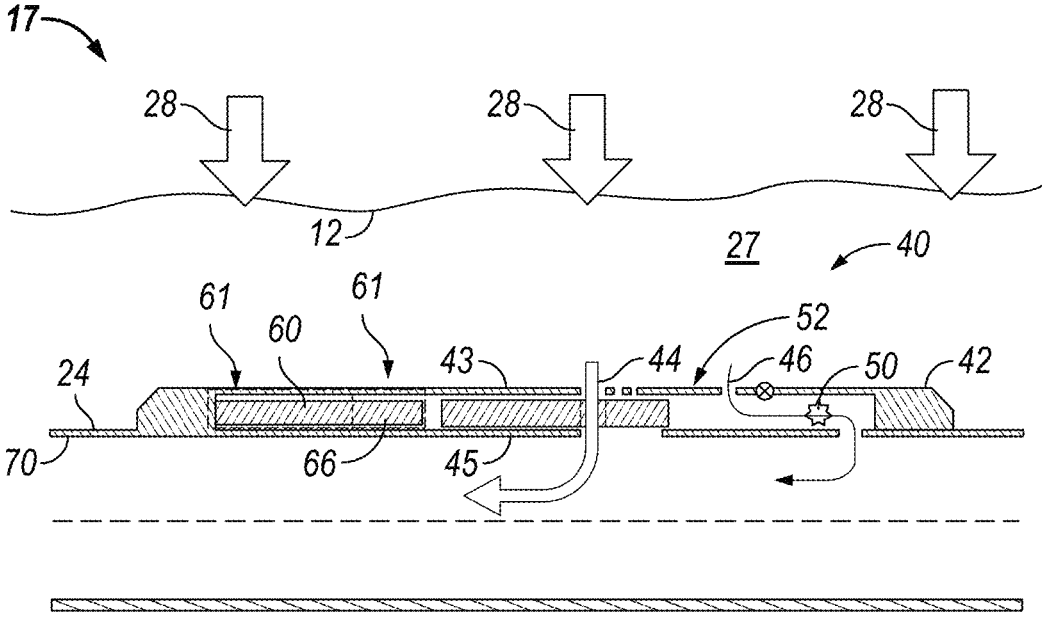
FIG. 2 is a sectional side view of one of the flow control nodes according to an example configuration.

FIG. 2 is a sectional side view of one of the flow control nodes 40 according to an example configuration. The flow control node 40 includes a flow control body (i.e., valve body) 42, an on-board electrical generator 50, a valve closure (i.e., closure) 52 moveably coupled to the flow control body 42, an electronics package 60, and an actuator 66. The electronics package 60 includes various electronic components such as a local, wireless transmitter/receiver used to communicate with other components of the smart well node system, a local (on-board) controller comprising a processor (i.e., a local processor) and control logic for controlling operation of on-board components, an optional battery pack, and various sensors or peripherals. The closure 52 is moveable with respect to the flow control body 42 for controlling flow through the flow control body 42 along one or more flow paths through the flow control body 42. The actuator 66 is used to drive the closure 52 in order to control flow of formation fluids at that location. The electronics package 60 and the actuator 66 are examples of downhole components that require electrical power. In an example configuration, the electronics package 60 may be modular. The modular electronics package 60 may be preconfigured with components selected specific to a particular system or desired tool configuration. The modular electronics package may be removably securable such as by inserting laterally in an exterior side pocket 61 of the flow control body 42, wherein the flow control body 42 may comprise a mandrel having the side pocket 61. Upon insertion into the side pocket 61, the modular electronics package 60 may automatically physically couple to the flow control body (e.g., by snapping in) and/or electrically connect to a portion of an electrical power grid within a larger smart node well system such as further described below. The actuator 66 may also be modular and similarly secured to a respective side pocket 63.

The flow control body 42 is fluidly coupled to a production conduit 70, defining an annulus 27 between the flow control body 42 and the wellbore 12. Formation fluid 28 flows from the formation 17 into the annulus 27 and from the annulus 27 into the production conduit 70 through the flow control node 40. The production conduit 70 may comprise production tubing 24 and/or other tubular members for conveying formation fluid 28 to surface. A portion of the production conduit 70 may also be defined by the flow control body 42 and other components fluidly coupled to the flow control body 42, such as a base pipe of a sand control assembly. The flow control body 42 may be generally round or tubular to conform with the wellbore 12 and to position around or otherwise in-line with production tubing 24 (one half of the flow control body 42 sectional view is omitted in this figure).

The flow control body 42 defines at least one primary flow path 44 extending from an exterior 43 of the flow control body 42 to an interior 45 of the flow control body 42 for producing formation fluids 28 into the production conduit 70. The primary flow path 44 shown may be one of a plurality of primary flow paths circumferentially spaced for entry of the formation fluids 28 into the production conduit 70. A portion of the flow through the flow control body 42 is also directed through the generator 50. In this example, the flow through the generator 50 is directed through the flow control body 42 along one or more secondary flow path 46 spaced from the primary flow path 44 that also extends from the exterior 43 to the interior 45 of the flow control node 40. Alternatively, the primary flow path 44 could be diverted inside the flow control node 40 along one or more secondary flow path to the generator 50. In either case, flow through the generator 50 may be expelled into the production conduit 70 along with other produced formation fluids.

The closure 52 is operable using the actuator 66 to adjust the flow of the formation fluids 28 through the primary and secondary flow paths 44, 46 of the flow control body 42. The actuator 66 may comprise an electric motor, solenoid, or other electronic actuation mechanism. The closure 52 may comprise any device operable by the actuator 66 to control flow. In this example, the closure 52 comprises a sleeve 54 that is moveable over a range of positions with respect to the flow control body 42, for selectively closing the primary flow path 42 and/or secondary flow path 44. Other examples of closures may alternatively include any suitable mechanism for adjusting flow of formation fluids 28 through the flow control body 42, both into the production conduit 70 and/or through the generator 50. In FIG. 2, the sleeve 54 is in a fully open position allowing maximum flow of the formation fluids 28 to flow both through the primary flow path. Thus, formation fluids 28 are flowing into the production conduit 70 through the primary flow path 44 for production to the surface and through the secondary flow path 46 for driving the generator 50.

The on-board electrical generator 50 may comprise a turbine, a flow vane, or other mechanism inside the flow control body 42 that generates an electrical current in response to fluid flow through the flow control body 42. The on-board electrical generator 50 may be capable of generating electrical power sufficient to operate its own components, such as the actuator 66 and the electronics package 60. In some cases, the generator 50 may directly power these components on the same flow control node. However, the generator 50 of this and other flow control nodes may feed an electrical power grid (i.e., power grid) discussed below. The flow control node 40 could then draw power as needed from the electrical power grid, even when the flow control node 40 is not currently generating power, such as when the sleeve 54 is in a fully closed position.

The size of the generator 50 and the corresponding range of flow rates to power the generator 50 may depend, for example, on the electrical power requirements of each flow control node 40 or the collective power requirements of all of the flow control node 40 in the smart well node system. The power requirement of and flow rate through the generator 50 may depend, directly or indirectly, on the size of the production conduit 70 and the power requirements of the closure 52 and its actuator 66, and the electronics package 60. As an order-of-magnitude type example, an flow control node 40 may have a nominal bore of less than about six inches, and the flow rate through the generator 50 of one flow control node 40 may be on the order of one gallon per minute (GPM) or less. However, a variety of different nominal bore sizes and flow rates are also possible of greater or less than these amounts. A typical flow rate through the secondary flow port 44 to power the generator 50 may therefore be significantly less than a flow rate through the primary flow path 44, which have ample capacity to produce a significant amount of formation fluids to be captured at the surface.

Figure 3:
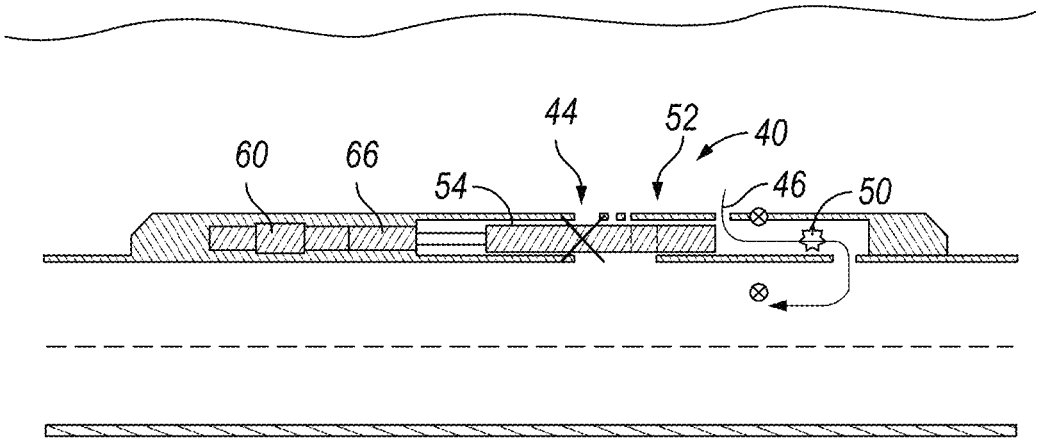
FIG. 3 is another sectional side view of the flow control node of FIG. 2, with the sleeve moved to an intermediate position that closes flow to the primary flow path while leaving the secondary flow path open.

FIG. 3 is another sectional side view of the flow control node 40 of FIG. 2, with the sleeve 54 moved to an intermediate position that closes flow to the primary flow path 44 while leaving the secondary flow path 46 open. This intermediate position effectively blocks production of formation fluids at that node, while still allowing sufficient flow through the secondary flow paths 46 to operate the generator 50 and generate sufficient electrical power to operate its own closure 52 if needed. Because the generator 50 is still receiving flow in this intermediate position, the flow control node 40 is capable of optionally using the power of its own generator 50 to shift the sleeve 54 back toward the fully open position of FIG. 2 or further toward a fully closed position of FIG. 4.

Figure 4:
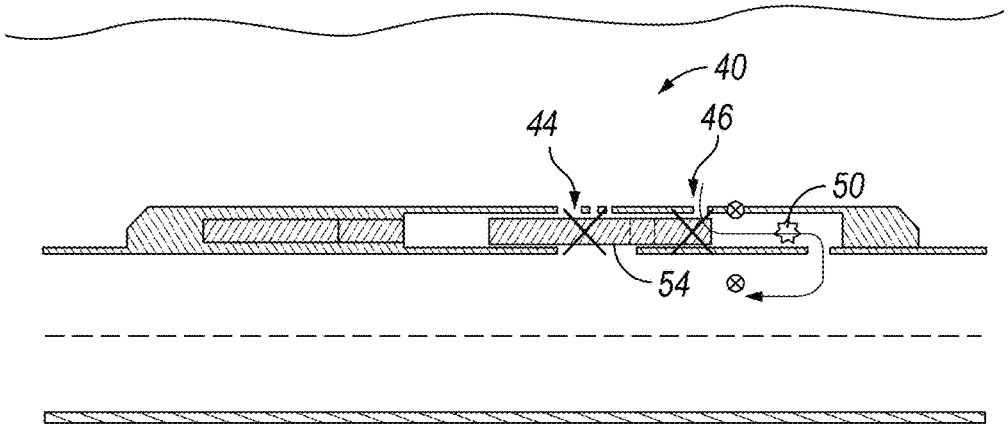
FIG. 4 is another sectional side view of the flow control node of FIG. 3, with the sleeve further moved to a fully closed position, closing both the primary flow path 44 and secondary flow path.

FIG. 4 is another sectional side view of the flow control node 40 of FIG. 3, with the sleeve 54 further moved to a fully closed position, closing both the primary flow path 44 and secondary flow path 56. Thus, no formation fluids are currently being produced and the on-board generator 50 is not generating any electrical power. The sleeve 54 may be moved to this fully closed position if, for example, stakeholders determine that oil or gas are no longer being produced in economic quantities at this node, in which case there may be no expected desire to reopen the sleeve. However, stakeholders may want the ability to reopen flow at that node, in case a mistake was made to shut flow at the node, or in case the formation conditions have changed. Fortunately, the flow control nodes may be interconnected on an electrical grid as shown in FIG. 5, with central flow management to selectively re-open the flow control node to restore life to a node that has been previously shut down.

Figure 5:
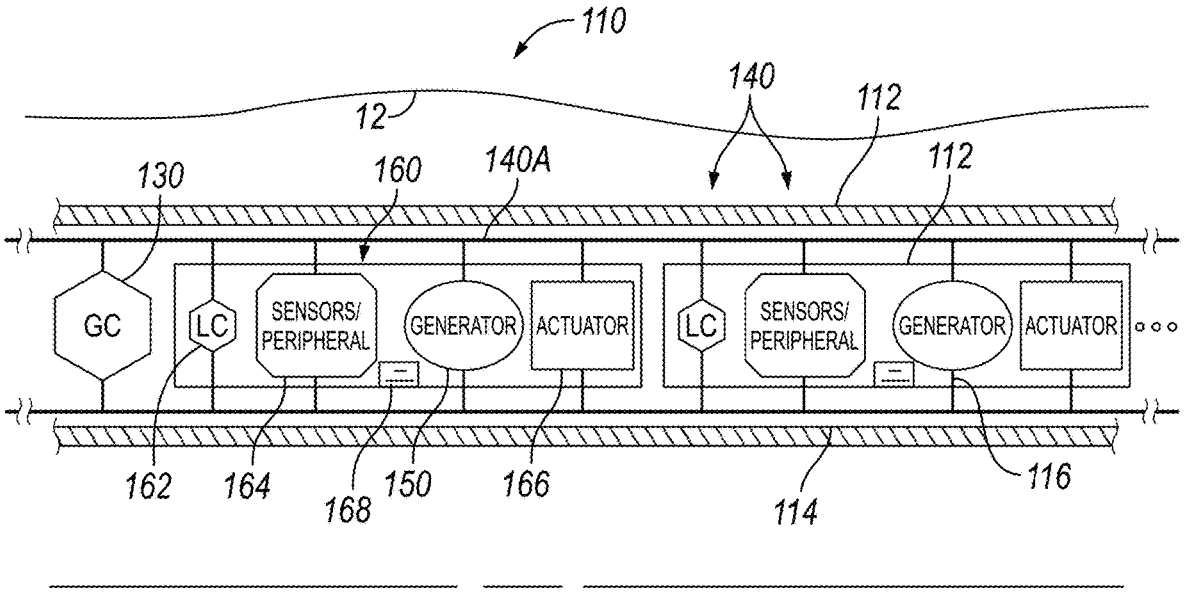
FIG. 5 is a schematic diagram of an electrical power grid interconnecting multiple nodes 140 spaced along the production conduit at different locations in the wellbore.

FIG. 5 is a schematic diagram of an electrical power grid 110 interconnecting multiple nodes 140 spaced along the production conduit 70 at different locations in the wellbore 12. The electrical power grid 110 interconnects the plurality of flow control nodes 140, which collectively supply electrical power to the power grid 110 and individually receive the electrical power from the electrical power grid 110. The electrical power grid 110 may comprise conductive paths schematically depicted at 112, 114, 116 of any suitable form, including but not limited to individual wires, circuit board traces, inductive or capacitive couplers, and the like. For example, conductive paths 112, 114 may form a bus for communication of power or data between nodes 140 or components of each node 140, while individual conductive paths 116 may couple specific components or specific nodes 140 to other conductive paths 112, 114. These conductive paths may be routed within the structure of the various completion components such as within the structure of a flow housing and along segments of subs or tubing interconnecting the nodes 140. Other electrical components not expressly shown in this figure, such as diodes, transformers, AC/DC converters and the like, may be included with the electrical power grid 110.

Two nodes 140A, 140B are shown by way of example, but any number of nodes 140 may be interconnected on the electrical power grid 110. The nodes 140 may represent the electronic subsystem of the flow control nodes 40 in the preceding figures, for example. Each node 140 includes the circuitry of an electronics package 160, including component circuitry for a local controller (LC) 162, sensors/peripherals 164, an electrical-powered actuator 166, and a generator 150 for alternately supplying electrical power to the electrical power grid 110 and/or its own electronics package 160. A battery pack 168 may also be included on each node 140. A controller (GC) 130 is also shown, which may manage power to and/or operation of all or a subset of the nodes 140, such as the nodes 140 in a particular zone. In some examples, as illustrated here in FIG. 5, the grid controller 130 may be a separate component connected to the various flow control node 40 of the smart well node system 100 of FIG. 1. In other examples, the grid controller 130 may be part of the downhole controller 30 of FIG. 1.

The grid controller 130 is coupled to the electrical power grid 110 and comprises control logic for dynamically coordinating which generators supply the electrical power to the grid 110. In at least some examples of a flow control system, such as incorporating the electrical power grid 110 of FIG. 5 into the example system of FIG. 1, each closure is alternately operable with the electrical power from the electrical grid 110 or with electrical power from its own generator 150. In at least some examples, each closure may be normally operated with the electrical power from its own generator 150 when sufficient, e.g., when sufficient flow is passing through that generator 150. Each closure is alternately operable from the power grid 110 when the electrical power from its own generator 150 is insufficient.

Thus, for example, each closure may be moveable between the open position and the intermediate position using its own generator 150 when the portion of flow directed through the generator 150 is sufficient to provide the electrical power to operate the respective closure. The closure may automatically switch to being powered by power from the electrical power grid 110 when the portion of flow directed through its generator 150 is insufficient to operate the respective closure.

Any electrical power from each node 140 in excess of its own needs at any given moment may be delivered to the electrical power grid 110 for use by other nodes 140. For example, when the closure of one node 140 is fully closed, it may be reopened using power from the electrical power grid 110 supplied by at least one other node 140. Thus, at any given moment, one or more flow control node 140 may supply electrical power to the electrical power grid 110 while at least one other flow control node 140 is simultaneously powered by the electrical power grid. In other examples, each node 140 may be always powered by electrical power from the electrical power grid 110, whether or not that node 140 is also supplying power to the electrical power grid 110 at that moment. The battery pack 168 may also be included, and selectively charged for use in certain contingencies, such as when a complete well shutdown is needed.

The electrical power grid comprises circuitry and control logic so that electrical power generated at each generator is processed into a usable form by the electrical power grid and back into usable form where it is consumed by various devices. For example, this may comprise circuit elements such as an alternating current (AC) to direct current (DC) converter to convert the electrical power generated by each generator to DC power for transmitting DC power over the electrical power grid and then converted back to DC power for use by device components. The phase, voltage, and so forth may also be managed.

Figure 6:
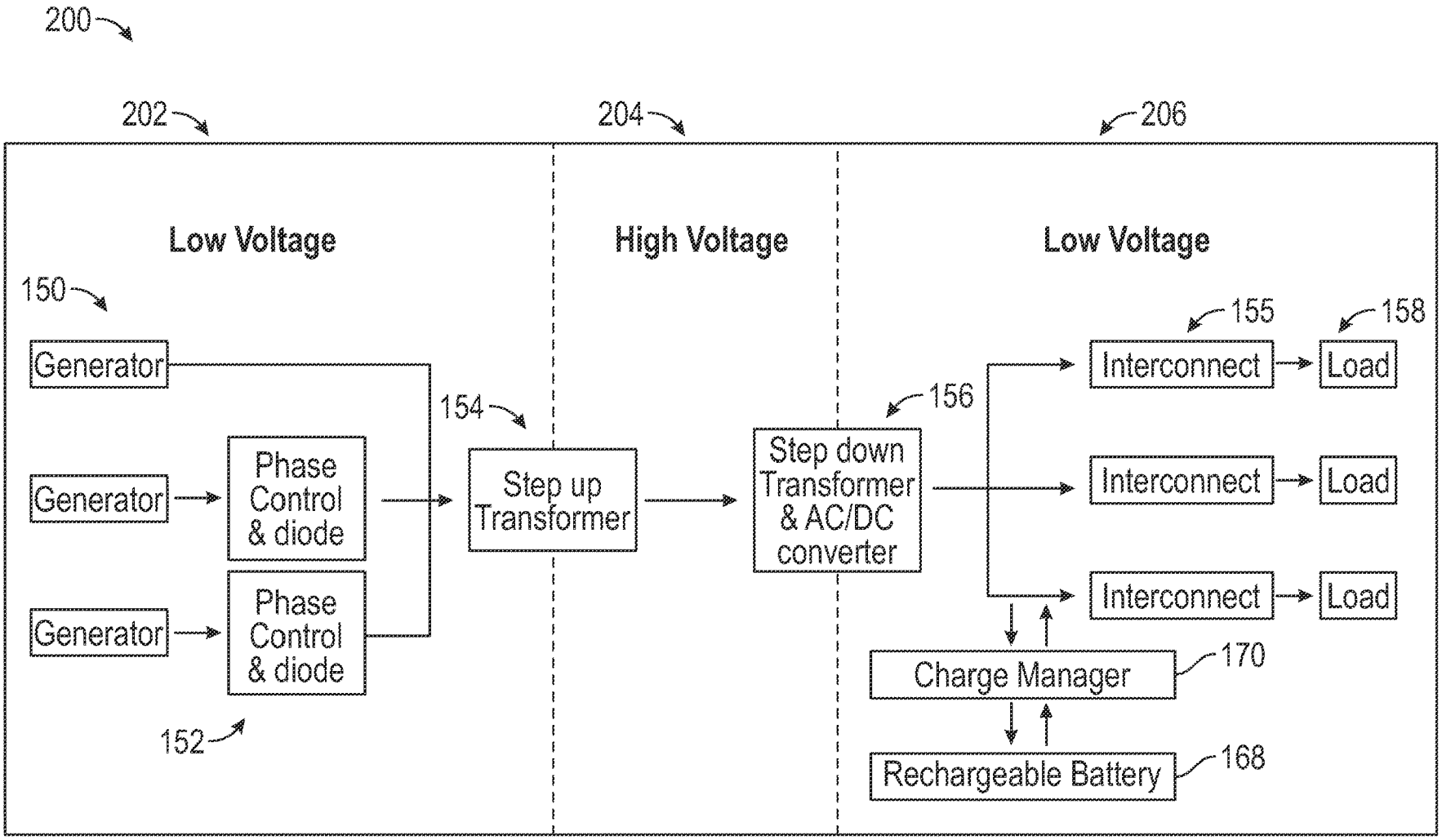
FIG. 6 is a schematic diagram of an example power management circuit for managing a smart node well system with an electrical power grid.

FIG. 6 is a schematic diagram of an example power management circuit 190 for managing a smart node well system with an electrical power grid. Generally, the power management circuit 190 is used to convert the power output at each generator 150 into a suitable form for transmission over the electrical power grid, then back into a usable form by various device components at the various nodes. The power management circuit 190 may control aspects such as phase, current type such as either alternating current (AC) or direct current (DC), and voltage. The power management circuit 190 is divided into, using relative terms, a low-voltage section 192, a high-voltage section 194, and another low-voltage section 196. The plurality of generators 150 feed into phase control and diode circuits 152, transitioning to the high-voltage section 194 using, e.g., a step-up transformer 154. The high-voltage section 194 is then stepped back down to the low-voltage section 196 using, e.g., a transformer and AC/DC converter section 156. The current is thereby transformed to a usable form to be fed to various loads 158, such as the actuator, local controller, sensors, and peripherals used by the various nodes via suitable interconnects 155.

A battery manager 170 is included for power management of the rechargeable battery 168. The battery manager 170 may comprise a battery recharge circuit comprising control logic for managing the battery 168. For safety, the battery manager 170 may normally maintain the battery 168 below a charge threshold when the node 140 is receiving electrical power from its own generator 150 or the electrical power grid 110. The battery manager 170 may then be used for charging the battery 168 to greater than the charge threshold when it is determined that the node 140 will be without available power, such as prior to moving the closure to a fully closed position.

Figure 7A:
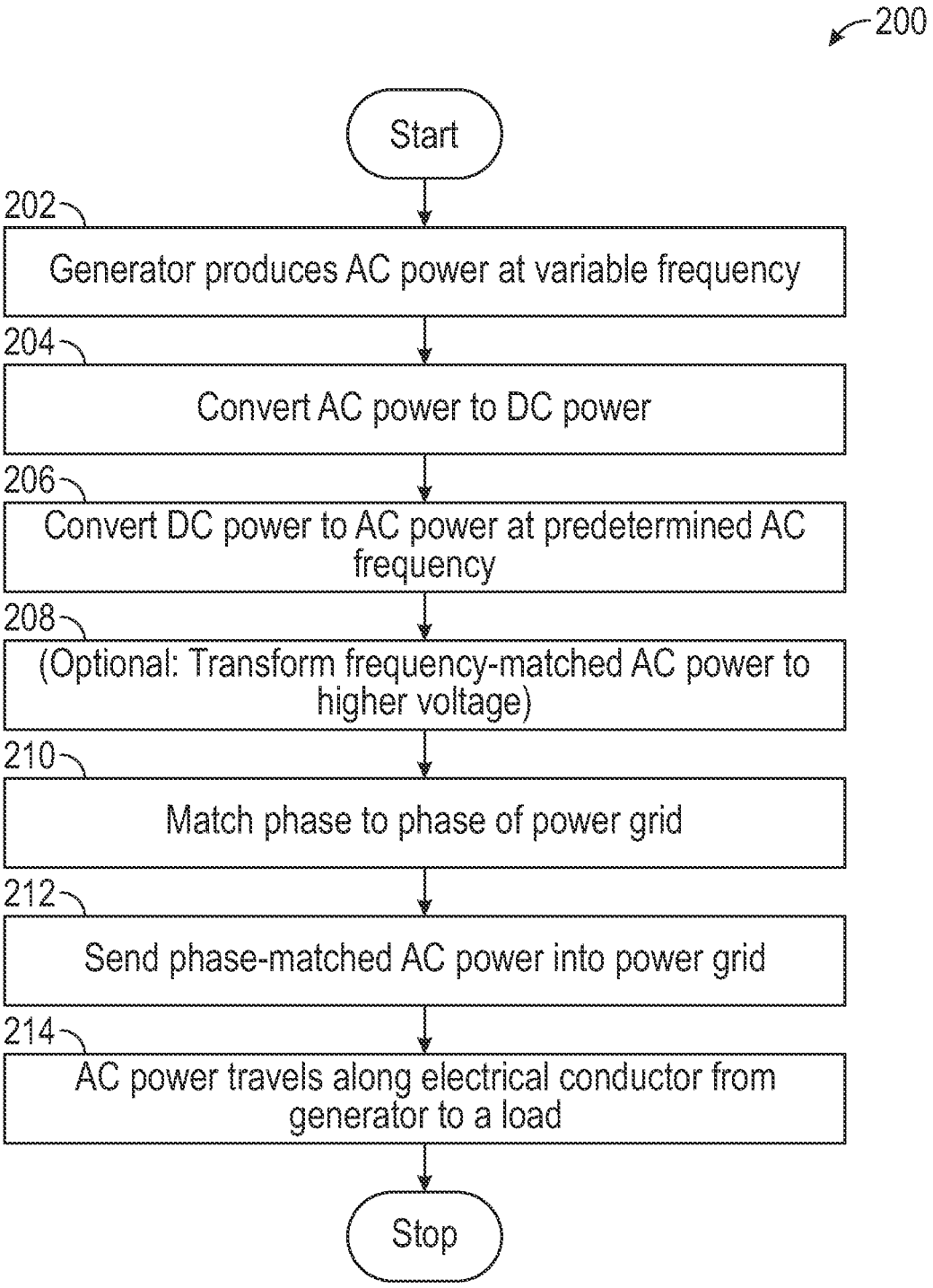
FIG. 7A outlines a power management method using an AC-type electrical power grid according to examples of the disclosure.
Figure 7B:
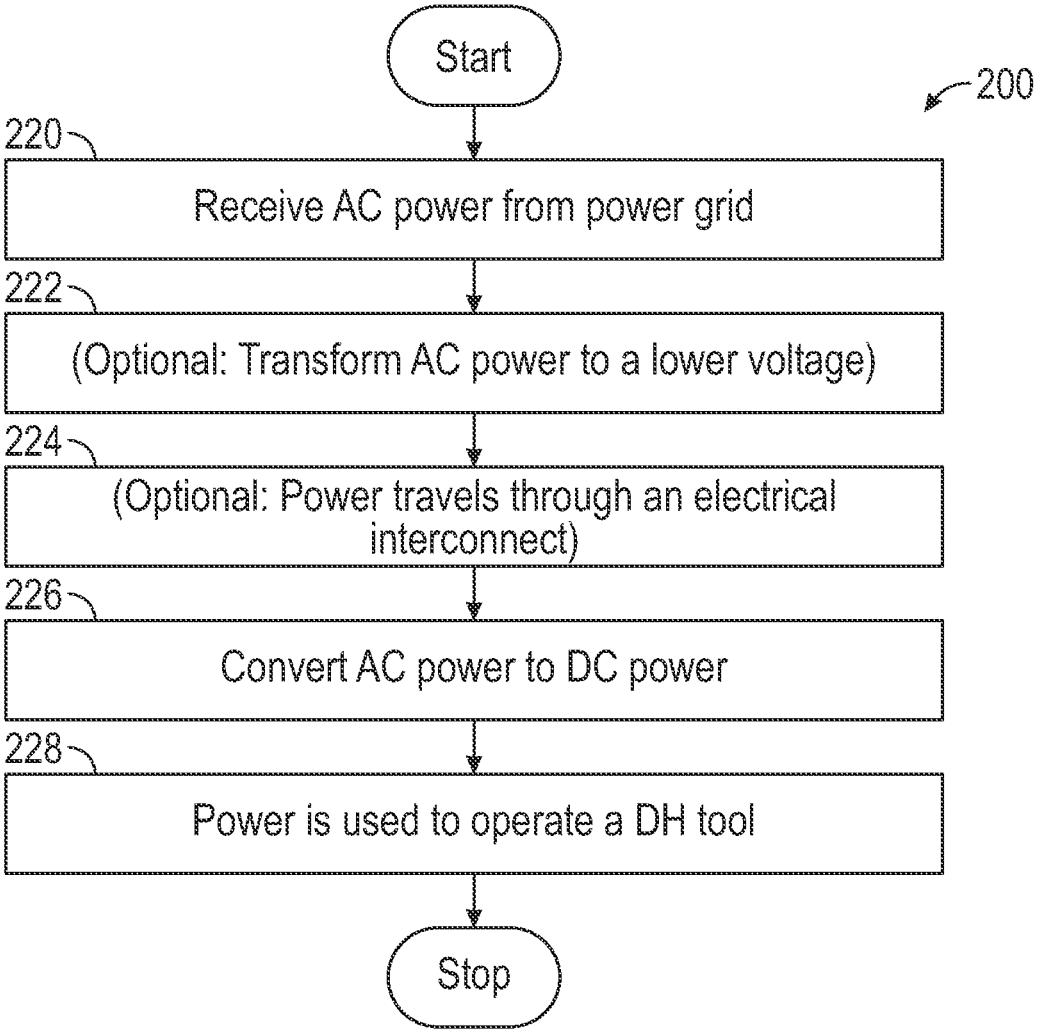
FIG. 7B continues the power management method of FIG. 7A.

FIGS. 7A and 7B together outline subroutines of a power management method 200 using an AC-type electrical power grid according to examples of the disclosure. Referring first to FIG. 7A, at block 202, each generator has an output, such as an AC power output at variable frequency, which must be processed by a power management circuit to be effectively distributed along a grid and converted back into usable form by various devices. The AC power produced at each generator is converted to DC power at Block 204. The DC power is then converted to AC power at a predetermined AC frequency at block 206. Optionally, the frequency-matched current of Block 206 may be transformed to a higher voltage at Block 208. The phase is then matched to a desired phase of the power grid at Block 210. The phase-matched AC power is then sent to the power grid at Block 212. The AC power travels along a respective electrical conductor from the generator to a load at Block 214. The electrical conductors may include wires, inductive couplers, capacitive coupler, or the like. If couplers are used, then the frequency of AC grid may be near resonant frequency of the couplers.

Turning now to FIG. 7B, the power management method picks up at Block 220, whereby AC power is received from the electrical power grid. Optionally, AC power that was at a higher voltage is transformed back to a lower voltage at Block 222. Power then optionally travels through an electrical interconnect at Block 224. This is converted from AC power back to DC power at Block 226. The DC power is then used to operate one or more device components at Block 228.

Figure 8:
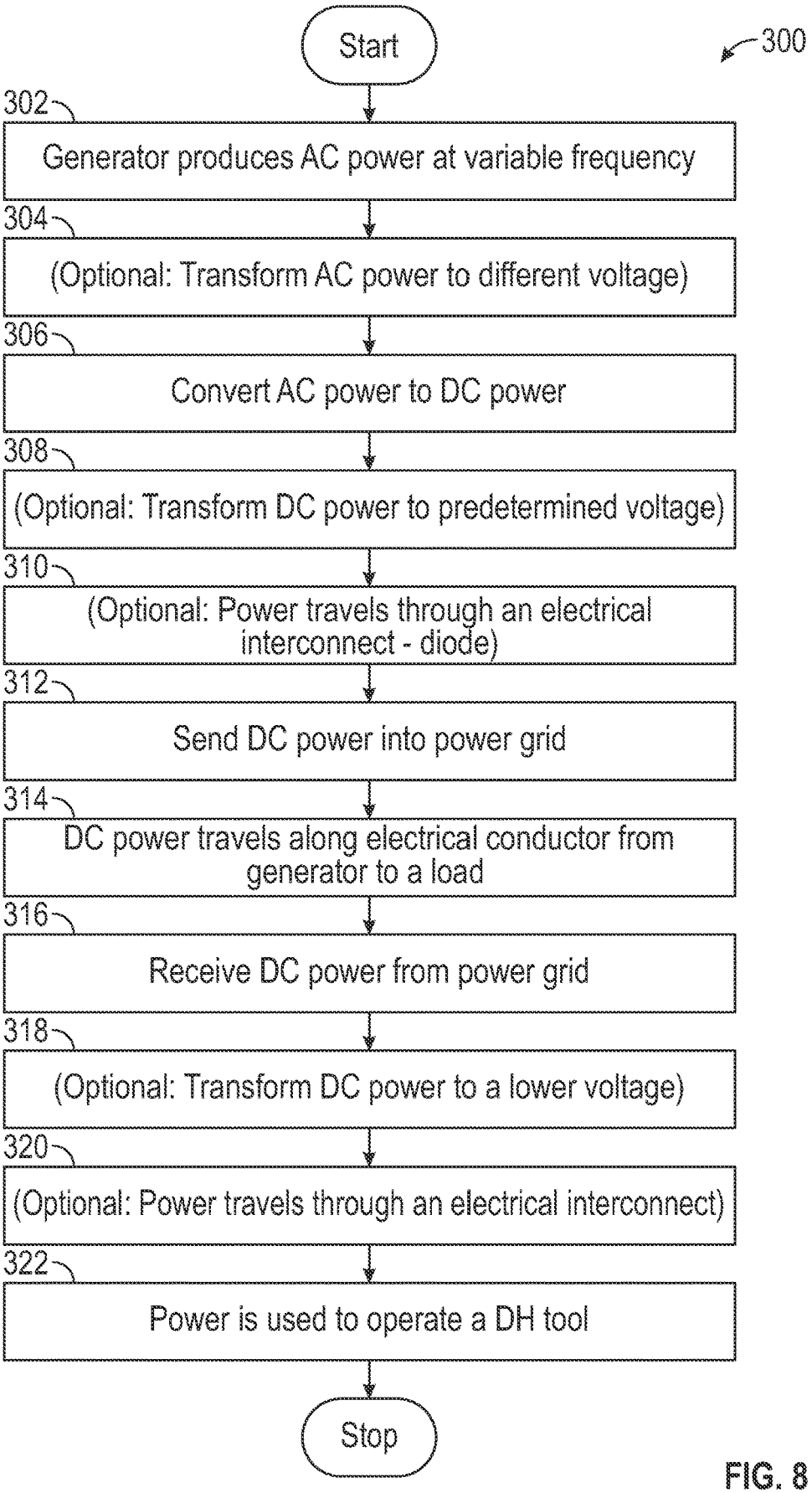
FIG. 8 outlines a power management method using a DC-type electrical power grid according to examples of the disclosure.

FIG. 8 outlines a power management method 300 using a DC-type electrical power grid according to examples of the disclosure. At Block 302, each generator produces AC power at a variable frequency that must be processed to be effectively distributed along a grid and converted back into usable form by various devices. Optionally, the AC power is transformed to a different voltage at Block 304. The AC power is converted to DC power at Block 306. Optionally, DC power is transformed to predetermined voltage at Block 308. Optionally, power also travels through an electrical interconnect (diode) at Block 310. The DC power is then sent into the power grid at Block 312. The DC power travels along an electrical conductor from a generator to a load at Block 314. At Block 316, DC power travels from the power grid, and is optionally transform to a lower voltage at Block 318. Power optionally travels through an electrical interconnect at Block 320. The power, now in usable form, is then used to operate a device component at Block 322.

The foregoing systems and circuitry allow for methods for controlling production flow in a well according to the disclosure, optionally using all-electric power generated downhole. An example is a method is provided for controlling a flow of formation fluids into a production conduit at each of a plurality of locations in a well where a flow control node is established. Electrical power is generated at each location in response to a portion of the flow into the production conduit at that location. The electrical power generated at the plurality of locations is collectively supplied to an electrical power grid. The flow of the formation fluids into the production conduit is independently adjusted at each location using the electrical power from the electrical power grid. Events may arise where the flow at a selected one of the locations is closed or otherwise reduced, intentionally or otherwise, such that insufficient electrical power is generated at that location to reopen flow at that location. Flow may be reopened at that location using electrical power from the electrical power grid, which is supplied by the electrical power generated at one or more other of the locations. The nodes may wirelessly communicate between each location along the well and a telemetry device and/or between the telemetry device and a surface of a well site.

Accordingly, aspects of the disclosure comprise a system and method to connect two or more wireless nodes with an electric line forming a downhole power grid. This method has several technical advantages. For example, this may allow a zone to completely shut down flow and reopen flow by using power from neighboring zones. If the generator of one zone fails, the zone can continue to operate by using power generated from a neighboring zones. More overall power is available, which can increase the forces of the motors shifting flow control valves/sleeves. Instead of having a processor for each zone, a central processor can be utilized to control all zones.

This decreases cost, simplifies wireless communication to surface, may increase reliability by having one or more redundant central processors. More power may enable the system to provide intermittent power to an auxiliary device (that requires more power) by combining the power from multiple generators. More overall power may also enable more sensors and other electrical instruments to be added. More overall further allows a more powerful and more capable central processor. As a failsafe design, a central battery pack may be used to get charged and power downhole devices if complete well shutdown is needed. The methods, systems, tools, and so forth may include any of the various features disclosed herein, including one or more of the following examples.

Example 1. A production flow control system, comprising: a production conduit disposable within a well; a plurality of flow control nodes spaced along the production conduit for controlling a flow of formation fluids into the production conduit at different locations in the well, each flow control node defining at least one flow path for entry of the formation fluids into the production conduit, a closure operable to adjust the flow of the formation fluids into the production conduit, and a generator that generates electrical power in response to a portion of the flow directed through the generator; and a power grid interconnecting the plurality of flow control nodes, wherein the generators of the flow control modes collectively supply electrical power to the power grid and wherein each closure is operable with the electrical power from the power grid.

Example 2. The flow control system of Example 1, wherein the at least one flow path include a primary flow path bypassing the generator into the production conduit and a secondary flow path through the generator into the production conduit.

Example 3. The flow control system of Example 2, wherein the closure is operable to selectively close either the primary flow path or both the primary and secondary flow paths.

Example 4. The flow control system of Example 1-3, wherein each flow control node comprises a valve body physically coupled to the production conduit and defining the at least one flow path for entry of the formation fluids into the production conduit, and wherein each closure comprises a sleeve moveable with respect to the valve body for selectively closing the at least one flow path.

Example 5. The flow control system of Example 1-4, wherein each closure is alternately operable with the electrical power from the electrical grid or with electrical power from its own generator.

Example 6. The flow control system of Example 5, wherein each closure is normally operated with the electrical power from its own generator when sufficient and from the power grid when the electrical power from its own generator is insufficient.

Example 7. The flow control system of Example 6, wherein each closure is moveable between at least a first position wherein the portion of flow directed through the generator is sufficient to provide the electrical power to operate the respective closure and a second position wherein the portion of flow directed through the generator is insufficient to operate the respective closure.

Example 8. The flow control system of Example 1-7, wherein the plurality of flow control nodes comprises a first flow control node that supplies electrical power to the power grid and a second flow control node that is simultaneously powered by the power grid.

Example 9. The flow control system of Example 8, wherein the plurality of flow control nodes span a plurality of producing intervals spaced apart in the formation, wherein the first flow control node is in a first producing interval and the second flow control node is in a second producing interval.

Example 10. The flow control system of Example 8-9, wherein the first flow control node and second flow control node are in a same producing interval.

Example 11. The flow control system of Example 1-10, further comprising: a grid controller coupled to the power grid and comprising control logic for dynamically coordinating which generators supply the electrical power to the grid.

Example 12. The flow control system of Example 1-12, wherein each flow control node further comprises an electronics package including a battery, a local processor, and a wireless receiver.

Example 13. The flow control system of Example 12, wherein the electronics package comprises a battery manager for maintaining the battery below a charge threshold when the closure is in an open position, and for charging the battery to greater than the charge threshold prior to moving the closure to a fully closed position.

Example 14. The flow control system of Example 1-13, further comprising:

a communication network for electronic communication between each flow control node and a surface of a well site.

Example 15. The flow control system of Example 14, wherein the communication network comprises a telemetry device for communicating from a downhole location to surface, including one or both of a wireless connection between the flow control nodes and the telemetry device and a wireless connection between the telemetry device and the surface of the well site.

Example 16. The flow control system of Example 1-15, further comprising an alternating current (AC) to direct current (DC) converter, wherein the electrical power generated by each generator comprises an alternating current (AC) converted to DC power by the AC to DC converter, wherein the DC power is transmitted over the power grid.

Example 17. A method of controlling production flow in a well, the method comprising: controlling a flow of formation fluids into a production conduit at each of a plurality of locations in a well; generating electrical power at each location in response to a portion of the flow into the production conduit at that location; collectively supplying the electrical power generated at the plurality of locations to a power grid; and independently adjusting the flow of the formation fluids into the production conduit at each location using the electrical power from the power grid.

Example 18. The method of Example 17, further comprising: closing the flow at a selected one of the locations such that insufficient electrical power is generated at that location to reopen flow at that location; and selectively reopening flow at that location using electrical power from the power grid supplied by the electrical power generated at one or more other of the locations.

Example 19. The method of Example 17-18, further comprising: wirelessly communicating between each location along the well and a telemetry device and/or between the telemetry device and a surface of a well site.

Example 20. The method of Example 17-19, further comprising: generating the electrical power at each location as AC power; converting the AC power to a DC power; and transmitting the DC power along the power grid to each location for powering control of flow at that location.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method of controlling production flow in a well, the method comprising:

controlling a flow of formation fluids into a production conduit at each of a plurality of locations in a well;

generating electrical power at each location in response to a portion of the flow into the production conduit at that location;

collectively supplying the electrical power generated at the plurality of locations to a power grid;

independently adjusting the flow of the formation fluids into the production conduit at each location using the electrical power from the power grid;

closing the flow at a selected one of the locations such that insufficient electrical power is generated at that location to reopen flow at that location; and selectively reopening flow at that location using electrical power from the power grid supplied by the electrical power generated at one or more other of the locations.

2. The method of claim 1, further comprising:

wirelessly communicating between each location along the well and a telemetry device and/or between the telemetry device and a surface of a well site.

3. The method of claim 1, further comprising:

generating the electrical power at each location as AC power or DC power;

converting the electrical power to the other of AC power and DC power; and transmitting the electrical power upon conversion along the power grid to each location for powering control of flow at that location.

4. A production flow control system, comprising:

a production conduit disposable within a well;

a plurality of flow control nodes spaced along the production conduit for controlling a flow of formation fluids into the production conduit at different locations in the well, each flow control node defining at least one flow path for entry of the formation fluids into the production conduit, a closure operable to adjust the flow of the formation fluids into the production conduit, a generator that generates electrical power in response to a portion of the flow directed through the generator; wherein the plurality of flow control modes comprises a first flow control mode that supplies electrical power to the power grid and a second flow control node that is simultaneously powered by the power grid; and a power grid interconnecting the plurality of flow control nodes, wherein the generators of the flow control nodes collectively supply electrical power to the power grid and wherein each closure is operable with the electrical power from the power grid.

5. The flow control system of claim 4, wherein the at least one flow path includes a primary flow path bypassing the generator into the production conduit and a secondary flow path through the generator into the production conduit.

6. The flow control system of claim 5, wherein the closure is operable to selectively close either the primary flow path or both the primary and secondary flow paths.

7. The flow control system of claim 4, wherein each flow control node comprises a valve body physically coupled to the production conduit and defining the at least one flow path for entry of the formation fluids into the production conduit, and wherein each closure comprises a sleeve moveable with respect to the valve body for selectively closing the at least one flow path.

8. The flow control system of claim 4, wherein each closure is alternately operable with the electrical power from the electrical grid or with electrical power from its own generator.

9. The flow control system of claim 8, wherein each closure is normally operated with the electrical power from its own generator when sufficient and from the power grid when the electrical power from its own generator is insufficient.

10. The flow control system of claim 9, wherein each closure is moveable between at least a first position wherein the portion of flow directed through the generator is sufficient to provide the electrical power to operate the respective closure and a second position wherein the portion of flow directed through the generator is insufficient to operate the respective closure.

11. The flow control system of claim 4, wherein the plurality of flow control nodes span a plurality of producing intervals spaced apart in the formation, wherein the first flow control node is in a first producing interval and the second flow control node is in a second producing interval.

12. The flow control system of claim 4, wherein the first flow control node and second flow control node are in a same producing interval.

13. The flow control system of claim 4, further comprising:

a grid controller coupled to the power grid and comprising control logic for dynamically coordinating which generators supply the electrical power to the grid.

14. The flow control system of claim 4, wherein each flow control node further comprises an electronics package including a battery, a local processor, and a wireless receiver.

15. The flow control system of claim 4, further comprising:

a communication network for electronic communication between each flow control node and a surface of a well site.

16. The flow control system of claim 15, wherein the communication network comprises a telemetry device for communicating from a downhole location to surface, including one or both of a wireless connection between the flow control nodes and the telemetry device and a wireless connection between the telemetry device and the surface of the well site.

17. The flow control system of claim 4, further comprising a converter for converting alternating current to direct current or direct current to alternating current, wherein the electrical power generated by each generator comprises alternating current converted to direct current or direct current converted to alternating current by the converter for transmission over the power grid.

18. A production flow control system, comprising:

a production conduit disposable within a well;

a plurality of flow control nodes spaced along the production conduit for controlling a flow of formation fluids into the production conduit at different locations in the well, each flow control node defining at least one flow path for entry of the formation fluids into the production conduit, a closure operable to adjust the flow of the formation fluids into the production conduit, wherein each flow control node further comprises an electronics package including a battery, a local processor, and a wireless receiver, wherein the electronics package comprises a battery manager for maintaining the battery below a charge threshold when the closure is in an open position, and for charging the battery to greater than the charge threshold prior to moving the closure to a fully closed position; and a power grid interconnecting the plurality of flow control nodes, wherein the generators of the flow control nodes collectively supply electrical power to the power grid and wherein each closure is operable with the electrical power from the power grid.

* * * * *